US005092300A

United States Patent [19]

Imoehl et al.

[11] Patent Number: 5,092,300

[45] Date of Patent: Mar. 3, 1992

[54] PLASTIC FUEL RAIL END JOINT

[75] Inventors: William J. Imoehl; Michael J. Hornby, both of Williamsburg, Va.

[73] Assignee: Siemens Automotive L.P., Auburn Hills, Mich.

[21] Appl. No.: 648,264

[22] Filed: Jan. 31, 1991

[51] Int. Cl.[5] ..... F02M 55/02

[52] U.S. Cl. ..... 123/469; 123/456; 285/305

[58] Field of Search ..... 123/456, 468, 469, 470, 123/472; 285/305, 403, 921, 319; 138/109

[56] References Cited

U.S. PATENT DOCUMENTS

| | | | |
|---|---|---|---|
| 3,560,027 | 2/1971 | Graham | 285/305 |
| 3,973,791 | 8/1976 | Porta et al. | 285/305 |
| 4,244,608 | 1/1981 | Stuemley | 285/305 |
| 4,453,747 | 6/1984 | Binba | 285/305 |
| 4,510,909 | 4/1985 | Elphick et al. | 123/469 |
| 4,526,411 | 7/1985 | Bartholomew | 285/305 |
| 4,570,602 | 2/1986 | Atkins et al. | 123/468 |
| 4,725,081 | 2/1988 | Bauer | 285/305 |
| 4,772,052 | 9/1988 | Morain | 285/305 |
| 4,776,313 | 10/1988 | Freismuth et al. | 123/468 |
| 4,844,515 | 7/1989 | Field | 285/305 |
| 4,869,534 | 9/1989 | Ketcham et al. | 285/305 |
| 4,878,174 | 10/1989 | Kojima et al. | 285/305 |
| 4,938,510 | 7/1990 | Gmeiner et al. | 285/305 |
| 5,000,614 | 3/1991 | Walker et al. | 285/305 |
| 5,002,030 | 3/1991 | Mahake | 123/468 |

FOREIGN PATENT DOCUMENTS 1425470 11/1968 Fed. Rep. of Germany ..... 285/305

*Primary Examiner*—E. Rollins Cross
*Assistant Examiner*—Thomas N. Moulis
*Attorney, Agent, or Firm*—George L. Boller; Russel C. Wells

[57] ABSTRACT

The joint between a molded plastic fuel rail and a metal fuel tube uses a metal tube retainer clip to keep the fuel tube inserted within the end of the main fuel rail hole in the molded plastic fuel rail. The molded plastic fuel rail has a slot in its sidewall, and the clip has a forked blade that is inserted through this slot so as to be disposed in interference relationship with an upset bead in the tube to thereby prevent the tube from being withdrawn from the plastic fuel rail. The clip is secured to the fuel rail assembly, either by a resilient clasp portion of the clip snapping onto the metal fuel tube exterior of the plastic fuel rail or by an apertured tab portion of the clip being fastened to the fuel rail by a screw. Where the end of the main fuel rail hole is considerably larger than the diameter of the fuel tube, a tubular plug is used between them. A portion of an injector retainer for retaining the fuel injectors in their sockets in the fuel rail is disposed in interference relationship with the clip to prevent the clip from being removed from the slot unless the injector retainer is first removed from interference relationship with the clip.

7 Claims, 3 Drawing Sheets

PLASTIC FUEL RAIL END JOINT

FIELD OF THE INVENTION

This invention relates generally to fuel rail assemblies for fuel-injected internal combustion engines, and in particular to a joint at the end of a plastic fuel rail for connecting a fuel tube to the fuel rail.

BACKGROUND AND SUMMARY OF THE INVENTION

Fuel rail assemblies for gasoline engines often comprise a metal fuel rail that contains the fuel injectors. Certain advantages may accrue by using a molded plastic part for the fuel rail. For example, a molded plastic fuel rail designed to accept bottom-feed fuel injectors can save on weight and provide for a reduction in the envelope that is occupied by the fuel rail assembly, and these are important considerations for automotive vehicle manufacturers. Furthermore, a single plastic fuel rail may provide certain savings over a metal fuel rail when the metal fuel rail is an assembly of individual metal pieces which must be joined in a fluid-tight manner by suitable joining processes.

Since a molded plastic fuel rail is essentially a tubular part, the mold for fabricating it typically comprises one or more core pins that must be extracted from the interior of the plastic after the plastic has solidified in the mold. In a mold in which a single core pin forms the main fuel rail hole the core pin is extracted by withdrawing it from one axial end of the fuel rail. Due to part and molding considerations the main fuel rail hole at this end of the fuel rail will typically be larger than the diameter of a metal fuel tube that is intended to be inserted into it to form a joint between the fuel tube and the fuel rail. The problem is therefore posed as to how to create such a joint in a manner that will be economical for production purposes, yet will also comply with relevant engineering specifications. The present invention is directed to a solution to this problem.

Briefly, the solution is embodied by means of a tubular plug that fits in a sealed manner to the end of the main fuel rail hole and that itself receives the fuel tube in a sealed manner. A slot extends through the sidewall of the fuel rail to intersect the main fuel rail hole closely adjacent the end of the fuel rail. A tube retainer clip passes through the slot and comprises a U-shaped notch that allows the clip to slide over the metal fuel tube. The fuel tube has a circular exterior bead that is overlapped by the margin of the clip that borders the U-shaped notch such that the bead is disposed more interiorly of the fuel rail hole with the result that the metal fuel tube is captured and cannot be withdrawn from the main fuel rail hole unless the clip is first removed. Yet, the tube can still be rotated within the fuel rail while captured, and this attribute is useful in allowing for proper alignment when the fuel rail assembly is being installed on an engine. In the completed fuel rail assembly, the clip is itself retained in its fuel-tube-capturing position by a suitable retention means. In one embodiment this retention means is by an integral clasp portion of the clip which snaps onto the fuel tube just beyond the end of the main fuel rail hole. In another embodiment this retention means comprises an apertured tab that is integrally formed with the clip, and a threaded fastener that passes through the aperture in the tab and into a threaded hole in a boss on the fuel rail. When a fuel injector retainer is assembled onto the fuel rail for the purpose of retaining the injectors in their sockets in the rail, the installed tube retainer clip may be prevented from being removed by a portion of the fuel injector retainer being disposed in an interference relationship to the clip.

Principles of the invention can also be applied to join another fuel tube to the opposite end of the main fuel rail hole whenever the fuel rail has a complete through-hole for its main fuel hole. Typically a majority of the length of such a through-hole is created by a molding core pin which is extracted from one end of the solidified plastic, and the opposite open end of the fuel rail which is to receive the other fuel tube may be made sufficiently small that the use of a plug is unnecessary, in which case, the other fuel tube will fit in a sealed manner directly into the opposite end of the through-hole without such an intervening plug.

Further features, advantages and benefits of the invention, along with those already introduced, will be seen in the ensuing description and claims which should be considered along with the accompanying drawings. The drawings, in which like reference numerals designate like parts, disclose a preferred embodiment of the invention according to the best mode contemplated at the present time in carrying out the invention.

DESCRIPTION OF THE PREFERRED EMBODIMENT

Figure 1:
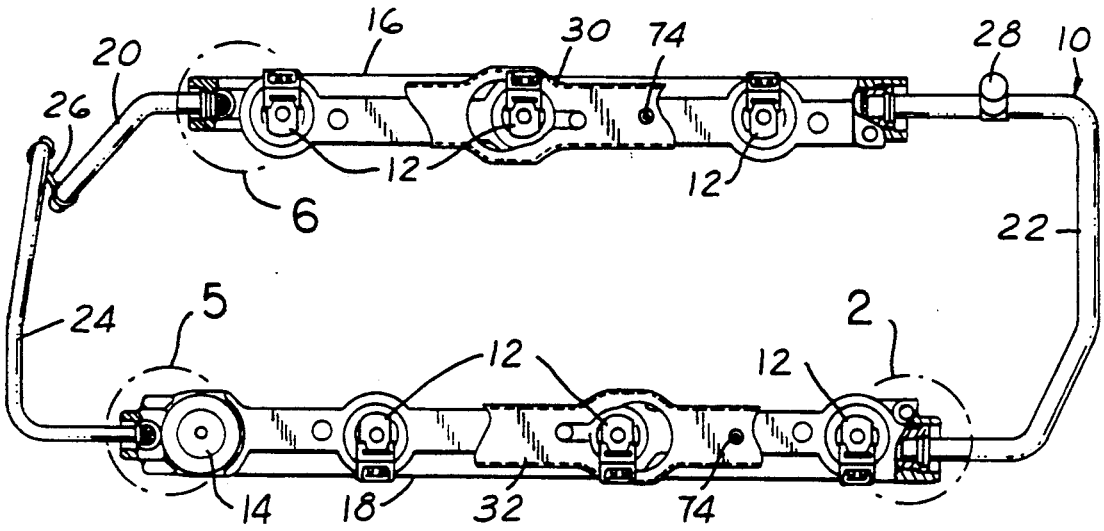
FIG. 1 is a top plan view of a fuel rail assembly embodying principles of the invention, certain portions being broken away.

FIG. 1 presents an example of a fuel rail assembly 10 that embodies principles of the invention. The example is for a V-6 engine (not shown in the drawings) and contains six electromagnetic operated fuel injectors 12 of the bottom-feed type and a pressure regulator 14. Three of the injectors are mounted on one molded plastic fuel rail 16 for serving the three engine cylinders on one side of the engine, and the remaining three injectors and the pressure regulator are mounted on another molded plastic fuel rail 18 for serving the three engine cylinders on the other side of the engine. Assembly 10 further comprises a metal inlet tube 20, a metal cross-over tube 22, and a metal outlet tube 24. Inlet tube 20 is joined to the left-hand end of fuel rail 16, cross-over tube 22 joins with the right-hand ends of both fuel rails 16 and 18, and outlet tube 24 is joined to the left-hand end of fuel rail 18. A strap 26 is used for holding the free ends of tubes 20 and 24 in a desired relationship for connection of the fuel rail assembly with a fuel supply line and a fuel return line (not shown), and cross-over tube 22 contains a diagnostic fitting 28. Stamped metal retainers 30 and 32 generally overlie the respective plastic fuel rails 16 and 18 and are shown in an interference relationship with the fuel injectors that prevents the fuel injectors from being removed from the fuel rails until such time as the retainers are unfastened from the fuel rails and moved to a non-interference relationship.

This much of the Description represents known fuel rail assembly technology. The fuel circuit through the fuel rail assembly comprises in order: inlet tube 20, fuel rail 16, cross-over tube 22, fuel rail 18, and outlet tube 24. A pressure regulated supply of liquid fuel is thus made available to all injectors so that when each injector is energized, it injects fuel toward the corresponding engine cylinder. It is to be appreciated that the electrical wiring to the fuel injector electrical connectors is not shown in the drawings although the connectors themselves can be seen.

Figure 2:
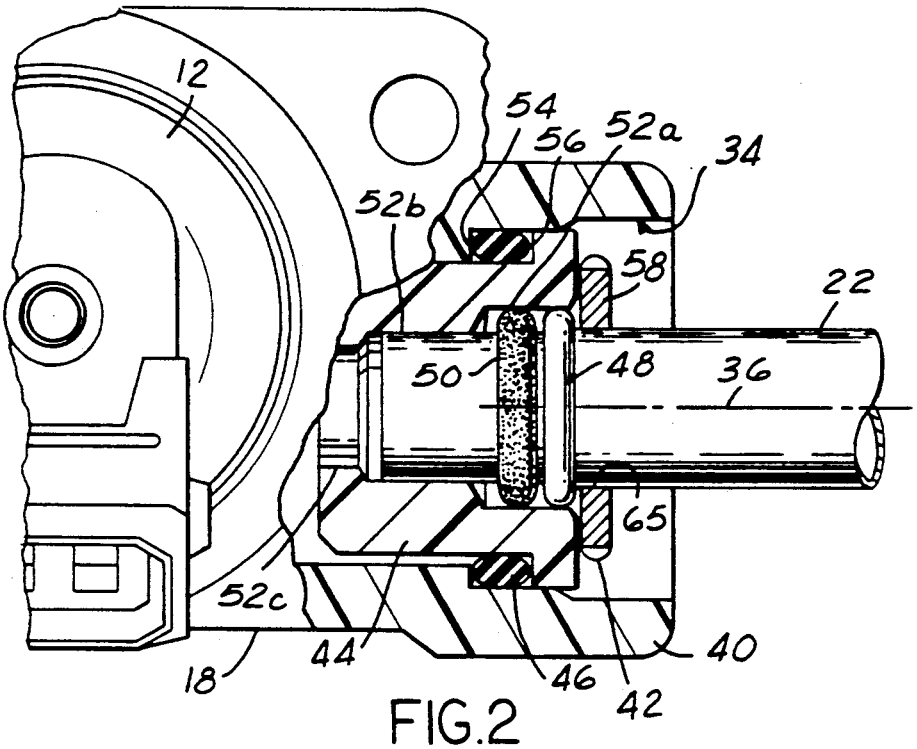
FIG. 2 is an enlarged view in circle 2 of FIG. 1.
Figure 3:
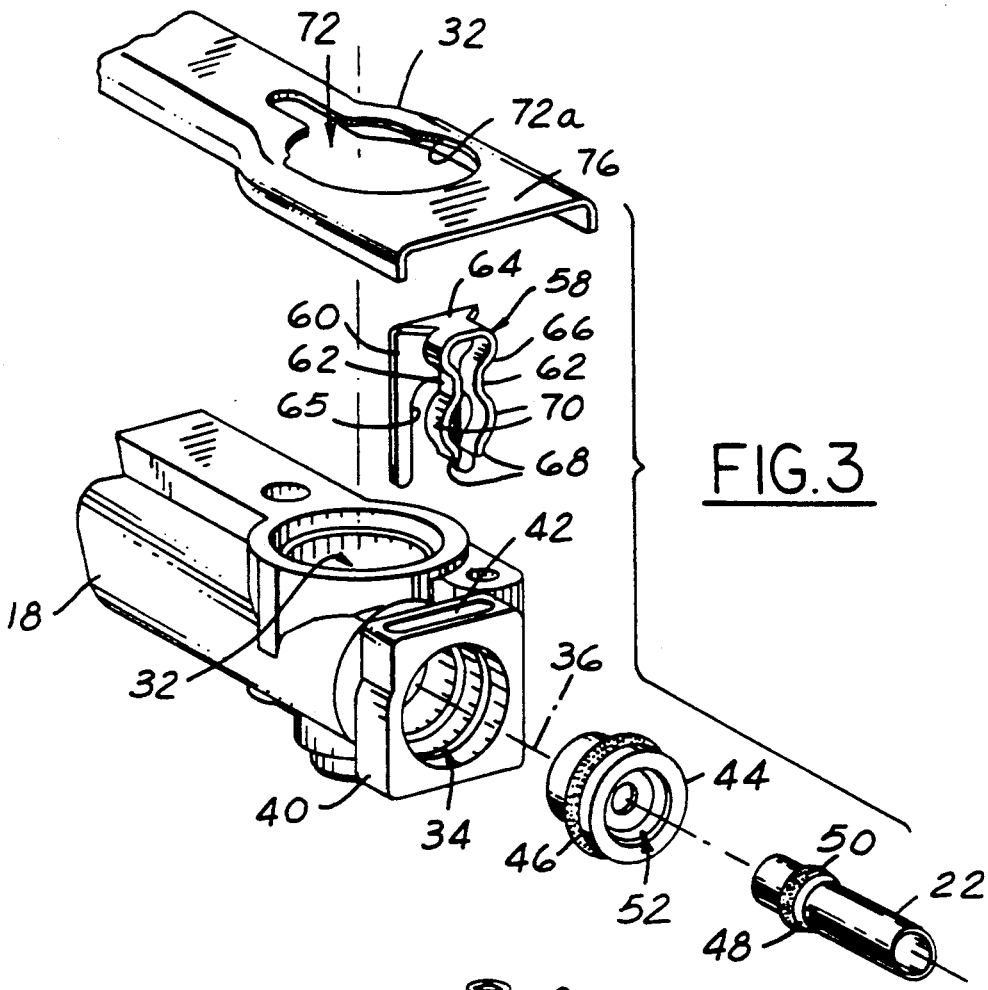
FIG. 3 is an exploded perspective view of FIG. 2, including further detail, but with the fuel injector omitted.

FIGS. 2 and 3 illustrate details of the joint between fuel rail 18 and cross-over tube 22. The right-hand end of fuel rail 18 in FIG. 1 represents the end at which the mold core that was used to create the main fuel hole 34 in the fuel rail was withdrawn, and so this end of the hole is larger than the opposite end. The main axis of hole 34 is represented by the numeral 36. Fuel rail 18 contains three transverse sockets 38 within which the corresponding three fuel injectors are disposed. These sockets transversely intersect hole 34. The sidewall of the fuel rail has a generally square shaped portion 40 at the larger end of hole 34. A slot 42 is provided in the square shaped portion 40, extending from the rail's exterior to intersect hole 34.

The joint further includes a tubular plug 44 that is disposed within hole 34. An O-ring seal 46 is disposed on plug 44. The end of tube 22 that joins with rail 18 contains a circular bead, or flange, 48 spaced proximally of the terminus of the end, and an O-ring seal 50 is disposed on tube 22 immediately distally of bead 48. Plug 44 contains a through-hole 52 having successively smaller diameter segments 52*a*, 52*b*, 52*c*. Hole 34 and plug 44 have respective shoulders 54 and 56, which abut opposite axial ends of O-ring 46 such that the extent to which plug 44 can be inserted into hole 34 is thereby defined. The O-ring seal provides fluid-tight sealing of the plug to the fuel rail in conventional sealing manner.

The abutment of O-ring 50 with bead 48 serves to axially locate the O-ring on the tube. The extent to which the tube can be inserted into hole 52 of plug 44 is defined by the abutment of the terminus of the tube with an internal shoulder that exists between the segments 52*b*, 52c, and when the tube terminus is so abutted with that shoulder, O-ring 50 and bead 48 are disposed within segment 52*a* such that the bead is essentially flush with the surrounding axial end face of plug 44 . O-ring 50 provides fluid-tight sealing of the tube to the plug in conventional sealing fashion.

A tube retainer clip 58 serves to complete the joint. Clip 58 comprises a generally planar forked blade portion 60, a resilient retention clasp portion 62, and a joining portion 64 that joins portions 60 and 62. The forked blade portion has a U-shaped notch 65. The resilient retention clasp portion comprises juxtaposed curved fingers 66. FIG. 3 illustrates the position to which clip 58 is disposed preparatory to completing the joint after both plug 44 and tube 22 have been assembled to the fuel rail in the manner described above. Portion 60 is aligned for insertion into slot 42 to capture bead 48, and portion 62 is aligned to be snapped onto tube 22 exterior of rail 18. As the clip is moved downwardly from the position illustrated in FIG. 3, notch 65 allows portion 60 to slide over the tube such that bead 48 is overlapped by a margin of the clip that borders the U-shaped notch. Concurrent with the downward motion of the clip, the outwardly canted distal ends 68 of fingers 66 engage the sidewall of tube 22, and the resultant interaction increasingly spreads the two fingers apart until a point is reached where the distance between the fingers passes over a diameter of the tube, at which time the resiliency of the fingers causes then to contract onto the tube to place the curved portions 70 that are immediately proximal end portions 68 into embracement with the tube. With the curved portions 70 embracing tube 22, portion 60 is maximally inserted into slot 42 such that there is somewhat more than 180 degrees of overlap of the margin of notch 65 with bead 48. The result is that both tube 22 and plug 44 are captured on the fuel rail, and the tube cannot be separated from the rail until the clip is removed in the opposite manner from which it was assembled into the joint. Depending upon the depth of the throat of notch 65, slot 42 may extend partially into the opposite side of square-shaped portion 40, as shown in FIG. 2.

Both retainers 30 and 32 contain holes 72 through which the exterior portions of the fuel injectors pass. FIG. 1 shows the retainers in interference relationship with the injectors to prevent the injectors from being removed from their sockets 38. The retainers are fastened to the fuel rails by means of threaded fasteners 74 that pass through clearance holes in the retainers and into tapped inserts that are pressed into the plastic of the rail. With the retainers so fastened, an interfering portion 76 of the retainer 32 overlies clip 58 to prevent the clip from being removed from the joint to a point that would allow tube 22 to be disconnected from fuel rail 18. Thus, the clip cannot be removed until the retainer is itself unfastened and removed. Removal of the retainer is accomplished after its unfastening by shifting it to the left in FIG. 1 to register the larger portion 72*a* of each hole 72 with the corresponding injector and thereby allow the retainer to be lifted away from the fuel rail.

The joint between tube 22 and fuel rail 16 is like that of FIGS. 2 and 3.

Figure 4:
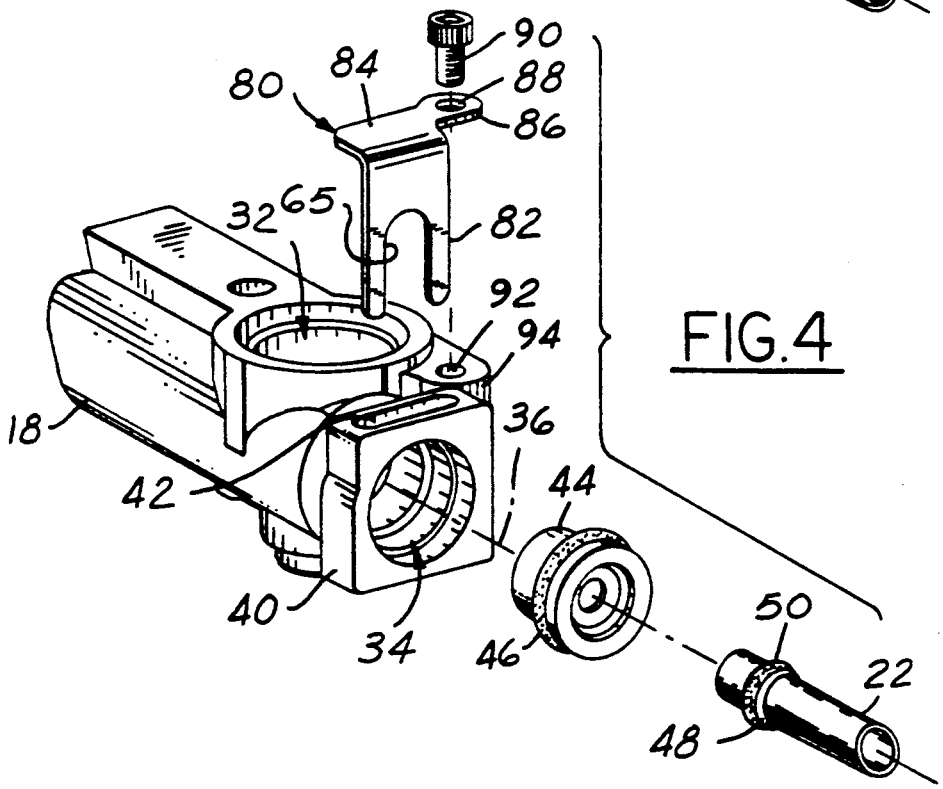
FIG. 4 is a view like FIG. 3 but illustrating a modified embodiment.

FIG. 4 illustrates an alternate embodiment of tube retention clip 80 which comprises a forked blade portion 82 like forked blade portion 60 of clip 58. Clip 80 has, instead of portions 62 and 64, a flange 84 with a tab 86 that contains an aperture 88. A threaded fastener 90 passes through aperture 88 and threads into a threaded insert in a hole 92 in a boss 94 of the fuel rail.

Figure 5:
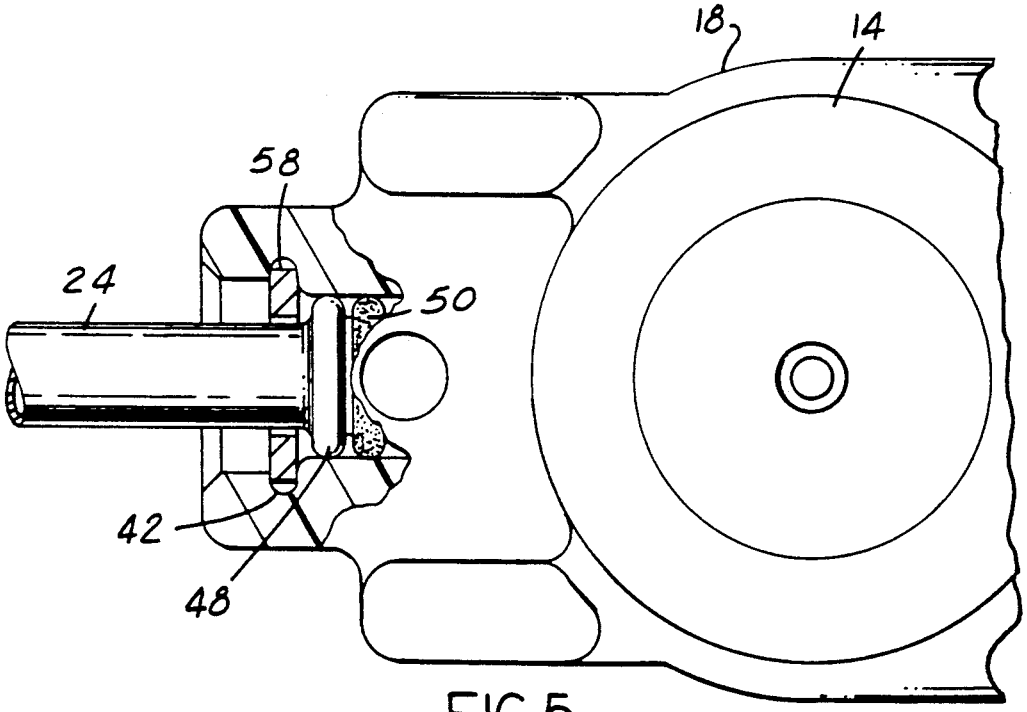
FIG. 5 is an enlarged view in circle 5 in FIG. 1.

The joint between tube 24 and rail 18 is illustrated by FIG. 5. This joint is like the joint of FIGS. 2 and 3 but does not use a plug 44 or O-ring seal 46 since this is the smaller end of the main fuel rail hole 34; rather, the tube end, including bead 48 and O-ring 50, is disposed directly in the fuel rail hole without an intervening plug.

Figure 6:
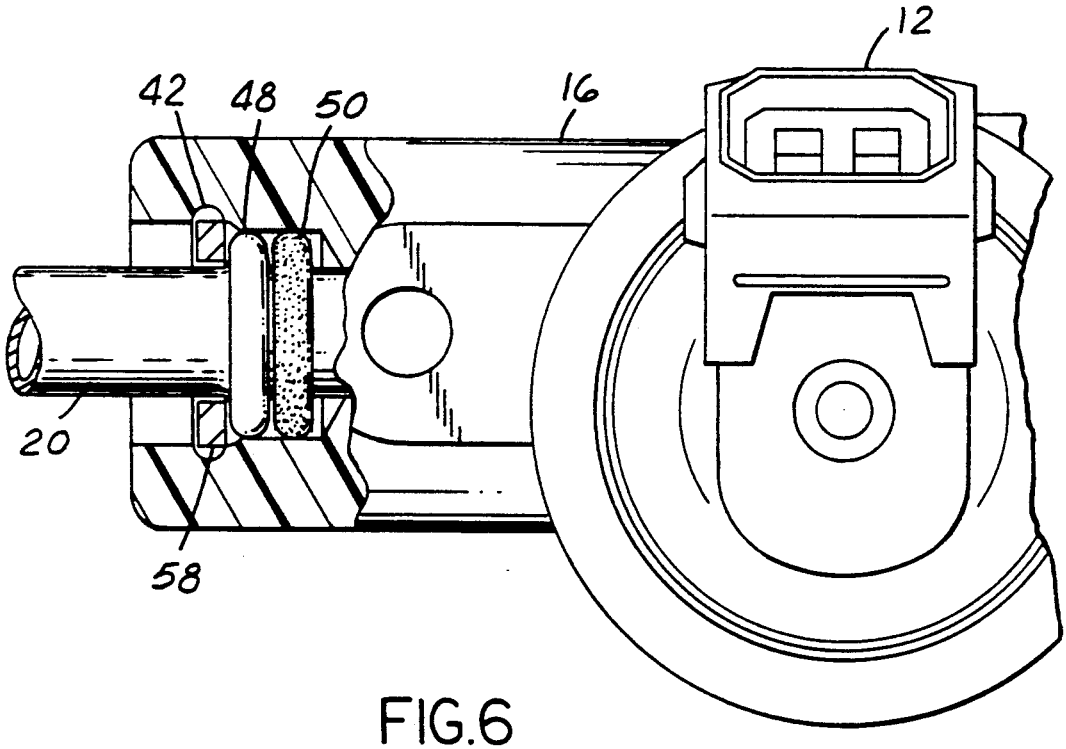
FIG. 6 is an enlarged view in circle 6 in FIG. 1.

The joint between tube 20 and fuel rail 16 is illustrated in FIG. 6 and is like that of FIG. 5 but involves a smaller diameter tube.

In those embodiments that use a plug 44, the plug may be a suitable plastic material. Preferably, the tube retention clips are fabricated from a suitable metallic material.

While a presently preferred embodiment of the invention has been illustrated and described, it should be appreciated that principles are applicable to other embodiments that are equivalent to the following claims.

What is claimed is:

1. In a fuel rail assembly having a molded plastic fuel rail which as a main fuel rail hole via which liquid fuel is delivered to one or more electric-operated fuel injectors that are received in sockets of the molded plastic fuel rail, said main fuel rail hole having an open end, said fuel rail assembly having a tube which has an open end, and said fuel rail assembly further having a fluid-tight joint which joins said open ends such that said main fuel rail hole and said tube are caused to form a fluid path through which liquid fuel is conveyed, the improvement in said joint which comprises:

said open end of said main fuel rail hole being larger than said open end of said tube, and said open end of said tube being disposed within said open end of said main fuel rail hole;

sealing means for sealing between said open end of said main fuel rail hole and said open end of said tube;

an external circumferentially extending flange on said tube which is disposed within said open end of said main fuel rail hole; and a tube retainer clip for keeping said open end of said tube within said open end of said main fuel rail hole;

said molded plastic fuel rail comprising a slot that extends from an exterior surface of said molded plastic fuel rail through a sidewall portion of said molded plastic fuel rail to intersect said main fuel rail hole;

said tube retainer clip comprising a blade that extends through said slot and into said main fuel rail hole in interference relationship to said tube's flange such that said interference relationship prevents said tube from being removed form said open end of said main fuel rail hole;

further including mean son said clip providing for the external attachment of said clip to said fuel rail assembly;

in which said means on said clip providing for the external attachment of said clip to said fuel rail assembly comprises an apertured tab portion, and said fuel rail assembly further includes a fastener that passes through said apertured tab portion to secure said apertured tab portion to said molded plastic fuel rail.

2. The improvement set forth in claim 1 in which said means on said clip providing for the external attachment of said clip to said fuel rail assembly comprises a resilient retention clasp portion that snaps onto said tube.

3. The improvement set forth in claim 1 in which said blade comprises a U-shaped notch that endows the blade with a forked shaped that fits over said tube.

4. The improvement set forth in claim 3 in which said tube's flange extends completely around said tube and the interference of said blade with said flange comprises somewhat more than 180 degrees of overlap of the margin of said notch with said flange.

5. In a fuel rail assembly having a molded plastic fuel rail which has a main fuel rail hole via which liquid fuel is delivered to one or more electric-operated fuel injectors that are received in sockets of the molded plastic fuel rail, said main fuel rail hole having an open end, said fuel rail assembly having a tube which has an open end, and said fuel rail assembly further having a fluid-tight joint which joins said open ends such that said main fuel rail hole and said tube are caused to form a fluid path through which joins said open ends such that said main fuel rail hole and said tube are caused to form a fluid path through which liquid fuel is conveyed, the improvement in said joint which comprises;

said open end of said main fuel rail hole being larger than said open end of said tube, and said open end of said tube being disposed within said open end of said main fuel rail hole;

sealing means for sealing between said open end of said main fuel rail hole and said open end of said tube;

an external circumferentially extending flange on said tube which is disposed within said open end of said main fuel rail hole; and a tube retainer clip for keeping said open end of said tube within said open end of said main fuel rail hole;

said molded plastic fuel rail comprising a slot that extends from an exterior surface of said molded plastic fuel rail through a sidewall portion of said molded plastic fuel rail to intersect said main fuel rail hole;

said tube retainer clip comprising a blade that extends through said slot and into said main fuel rail hole in interference relationship to said tube's flange such that said interference relationship prevents said tube from being removed from said open end of said main fuel rail hole;

further including means on said clip providing for the external attachment of said clip to said fuel rail assembly; and further including an injector retainer that is separably attached to said molded plastic fuel rail to retain said fuel injectors in said sockets, said injector retainer comprising an interfering portion that is disposed in interference relationship with said clip such that said blade cannot be removed from interference with said tube's flange unless said injector retainer is released from its injector retaining position.

6. In a fuel rail assembly having a molded plastic fuel rail which has a main fuel rail hole via which liquid fuel is delivered to one or more electric-operated fuel injectors that are received in sockets of the molded plastic fuel rail, said main fuel rail hole having an open end, said fuel rail assembly having a tube which has an open end, and said fuel rail assembly further having a fluid-tight joint which joins said open ends such that said main fuel rail hole and said tube are caused to form a fluid path through which liquid fuel is conveyed, the improvement in said joint which comprises:

said open end of said main fuel rail hole being larger than said open end of said tube, and said open end of said tube being disposed within said open end of said main fuel rail hole;

sealing means for sealing between said open end of said main fuel rail hole and said open end of said tube;

an external circumferentially extending flange on said tube which is disposed within said open end of said main fuel rail hole; and a tube retainer clip for keeping said open end of said tube within said open end of said main fuel rail hole;

said molded plastic fuel rail comprising a slot that extends from an exterior surface of said molded plastic fuel rail through a sidewall portion of said molded plastic fuel rail to intersect said main fuel rail hole;

said tube retainer clip comprising a blade that extends through said slot and into said main fuel rail hole in interference relationship to said tube's flange such that said interference relationship prevents said tube from being removed form said open end of said main fuel rail hole;

further including an injector retainer that is separably attached to said molded plastic fuel rail to retain said fuel injector sin said sockets, said injector retainer comprising an interfering portion that is disposed in interference relationship with said clip such that said blade cannot be removed from interference with said tube's flange unless said injector retainer is released from its injector retaining position.

7. In a fuel rail assembly having a molded plastic fuel rail which has a main fuel rail hole via which liquid fuel is delivered to one or more electric-operated fuel injectors that are received in sockets of the molded plastic fuel rail, said main fuel rail hole having an open end, said fuel rail assembly having a tube which has an open end, and said fuel rail assembly further having a fluid-tight joint which joins said open ends such that said main fuel rail hole and said tube are caused to form a fluid path through which liquid fuel is conveyed, the improvement in said joint which comprises:

said open end of said main fuel rail hole being larger than said open end of said tube, and said open end of said tube being disposed within said open end of said main fuel rail hole;

sealing means for sealing between said open end of said main fuel rail hole and said open end of said tube;

an external circumferentially extending flange on said tube which is disposed within said open end of said main fuel rail hole; and a tube retainer clip for keeping said open end of said tube within said open end of said main fuel rail hole;

said molded plastic fuel rail comprising a slot that extends from an exterior surface of said molded plastic fuel rail through a sidewall portion of said molded plastic fuel rail to intersect said main fuel rail hole;

said tube retainer clip comprising blade that extends through said slot and into said main fuel rail hole in interference relationship to said tube's flange such that said interference relationship prevents said tube from being removed from said open end of said main fuel rail hole; and in which said sealing means comprises a tubular plug that is disposed between said tube and said main fuel rail hole, an O-ring seal between said plug and said tube, and another O-ring seal between said plug and said main fuel rail hole.

* * * * *